US010980294B2

(12) United States Patent
Li et al.

(10) Patent No.: US 10,980,294 B2
(45) Date of Patent: Apr. 20, 2021

(54) LEG-PROTECTING APPARATUS HAVING DYNAMIC BIOLOGICAL FUNCTION

(71) Applicant: The Hong Kong Research Institute of Textiles and Apparel Limited, Kowloon (CN)

(72) Inventors: Yi Li, Hung Hom (CN); Yinglei Lin, Hung Hom (CN); Shu Sun, Hung Hom (CN); Xiao Han, Hung Hom (CN); Jinyun Zhou, Hung Hom (CN); Xuyong Cao, Hung Hom (CN); Yueping Guo, Hung Hom (CN); Jiao Jiao, Hung Hom (CN); Ru Lv, Hung Hom (CN); Qing Ye, Hung Hom (CN)

(73) Assignee: The Hong Kong Research Institute of Textiles and Apparel Limited, Kowloon (CN)

( * ) Notice: Subject to any disclaimer, the term of this patent is extended or adjusted under 35 U.S.C. 154(b) by 436 days.

(21) Appl. No.: 15/579,667

(22) PCT Filed: Jun. 17, 2015

(86) PCT No.: PCT/CN2015/081706
§ 371 (c)(1),
(2) Date: Dec. 19, 2017

(87) PCT Pub. No.: WO2016/192135
PCT Pub. Date: Dec. 8, 2016

(65) Prior Publication Data

US 2018/0184731 A1 Jul. 5, 2018

(30) Foreign Application Priority Data

Jun. 5, 2015 (CN) ..... 201510307042.4

(51) Int. Cl.
*A41D 13/05* (2006.01)
*A63B 71/12* (2006.01)
*A41D 31/18* (2019.01)

(52) U.S. Cl.
CPC ..... *A41D 13/0543* (2013.01); *A41D 31/18* (2019.02); *A63B 71/1225* (2013.01);
(Continued)

(58) Field of Classification Search
CPC ..... A61F 5/0106; A61F 5/0109; A61F 5/123; A61F 5/125; A61F 5/013;
(Continued)

(56) References Cited

U.S. PATENT DOCUMENTS 4,340,091 A * 7/1982 Skelton ..... A61F 2/06
139/383 R
5,171,273 A * 12/1992 Silver ..... A61L 27/24
623/13.11

(Continued)

FOREIGN PATENT DOCUMENTS

CN 101357004 2/2009
CN 201727931 * 2/2011 ..... A63B 71/12
CN 102548438 7/2012

OTHER PUBLICATIONS

Materials Data Book. Cambridge University Engineering Department. 2003 Edition. Accessed Feb. 19, 2020. (Year: 2003).*

(Continued)

*Primary Examiner* — Rachael E Bredefeld
*Assistant Examiner* — William T Kao
(74) *Attorney, Agent, or Firm* — BakerHostetler

(57) ABSTRACT

A leg-protecting apparatus is arranged in close contact with a body surface of a wearer to cover a thigh, a knee, and a calf of the wearer, including a biomechanically protecting strap arranged to correspond with structural locations and paths of (Continued)

tendons and ligaments of the knee and muscles proximal thereto during an exercise process. The strap comprises a cruciate ligament protecting strap, a patellar tendon protecting strap, a thigh muscle group protecting strap, and a calf muscle group protecting strap. Elastic moduli of the cruciate ligament protecting strap and the patellar tendon protecting strap has a step-change upon a change in a fabric tensile ratio caused by the knee bending of the wearer, wherein the step-change occurs after an initial low tensile modulus stage, during a tensile sudden-change stage, and before a high tensile modulus stage transitioning between the stages as knee angle decreases.

12 Claims, 5 Drawing Sheets

(52) U.S. Cl.
CPC . *A63B 2071/125* (2013.01); *A63B 2071/1241* (2013.01); *A63B 2071/1266* (2013.01)

(58) Field of Classification Search
CPC ..... A61F 2005/0172; A61F 2005/0176; A41D 13/0005; A41D 13/05; A41D 13/0543; A41D 13/06; A41D 13/065; A41D 13/07; A41D 13/08; A63B 71/1225; A63B 21/02; A63B 21/04–0407; A63B 21/4011; A63B 21/4025; A63N 2071/125; A63N 2071/1241; A63N 2071/1266; D04B 1/24; D04B 21/14; D04B 21/20
USPC ..... 442/321, 313, 314; 428/212; 602/3, 20, 602/23, 26, 62
See application file for complete search history.

(56) References Cited

U.S. PATENT DOCUMENTS

| | | | | |
|---|---|---|---|---|
| 5,452,475 | A | 9/1995 | Hunt, Jr. | |
| 6,436,066 | B1 * | 8/2002 | Lockhart | A61F 5/0125 602/26 |
| 9,314,364 | B2 * | 4/2016 | Nelson | A61F 5/0106 |
| 2007/0021699 | A1 * | 1/2007 | Braunstein | A61F 5/0109 602/5 |
| 2009/0105622 | A1 * | 4/2009 | Sterling | A61F 5/0123 602/26 |
| 2009/0162651 | A1 * | 6/2009 | Rios | B32B 3/30 428/354 |
| 2010/0036303 | A1 | 2/2010 | Bauerfeind et al. | |
| 2012/0010548 | A1 * | 1/2012 | Scholtes | A61F 5/0106 602/26 |
| 2012/0078151 | A1 * | 3/2012 | Cropper | A61F 5/30 602/26 |
| 2016/0017521 | A1 * | 1/2016 | Thomson | D03D 15/08 66/171 |

OTHER PUBLICATIONS

Belvedere, Ensini, Felicangeli, Cenni, D'Angeli, Glannini, & Leardini. Geometrical changes of knee ligaments and patellar tendon during passive flexion. Journal of Biomechanics. 2012; 45(11):1886-92. doi: 10.1016. Accessed Feb. 25, 2020. (Year: 2012).*

International Search Report and Written Opinion issued in parent PCT/CN2015/081706, dated Mar. 11, 2016.

* cited by examiner

LEG-PROTECTING APPARATUS HAVING DYNAMIC BIOLOGICAL FUNCTION

TECHNICAL FIELD

The present disclosure relates to the field of sports safety protecting apparatus, and in particular, to a leg-protecting apparatus that provides protection, comfort, and health to legs and knee joints in exercise.

BACKGROUND

As is known in the art, a full-leg-protecting apparatus includes a calf part, a knee joint part, and a thigh part, and is a protecting apparatus that is used by a sportspeople in an exercise process to protect knee joints and muscle groups of legs to avoid or reduce the potential for sports injuries. Generally, the full-leg-protecting apparatus is divided into parts: an elastic sleeve, a support member, upper and lower edge members, and the like.

Referring to FIG. 1, the knee joint includes medial and lateral condyles of the femur, medial and lateral condyles of the tibia, and the patella, and is the largest human body joint that is most complex and most easily injured. Stability of the knee joint mainly depends on ligaments and muscles. Both medial and lateral collateral ligaments and cruciate ligaments are very important for normal activities of a human body. The cruciate ligaments in the knee joint, also referred to as cruciform ligaments, include the anterior and posterior cruciate ligaments, and connect the femur to the tibia. No matter whether the knee joint extends straight or is bent, the anterior and posterior cruciate ligaments are both in a tense state. In an exercise process, the cruciate ligaments may be injured in the case of insufficient protection of the muscles. A patellar tendon, also referred to as a patella tendon, is a tendon connected between the patella and the tibia. If the patellar tendon is overused or overloaded, patellar tendonitis is possibly caused. Using a protecting apparatus to provide pressure supporting is an effective treatment method.

A lower end of the iliotibial band is attached to the lateral condyles of the tibia, the fibular head, and a bursa of the knee joint. A pes anserinus tendon is an attaching point of tendinous parts of three muscles of a sartorius muscle, a gracilis muscle, and a semitendinosus muscle at the medial proximal of the tibia. As is known in the art, the shape of the pes anserinus tendon is similar to a goose's foot, hence the name.

During knee bending, the main flexor muscles are biceps femoris of a posterior thigh muscle group. Additional flexor muscles further include a gracilis muscle and a sartorius muscle of a thigh muscle group and a popliteus muscle and a gastrocnemius muscle of a calf muscle group. Main extensor muscles are quadriceps femoris of an anterior thigh muscle group. When a sportsman is doing a deep squat, the main involved leg muscles include the quadriceps femoris and the posterior thigh muscle group, as well as thigh adductors and the soleus muscle and the gastrocnemius muscle of the calf muscle group.

In exercise, when a sportsman is doing a squat and bending his knees, the sportsman can maintain the squat position without falling down when the thigh muscles, especially the quadriceps femoris, produce sufficient bearing muscle strength. When the sportsman squats deeper and a knee bending angle becomes smaller, the arm of force may be relatively enhanced, but the lever arm does not change. Therefore, the muscle strength needs to be increased, and the largest knee bending amplitude can be maintained only by the muscle strength four to five times larger than the gravity. A protection method is training the sportsman thus: Do not squat extremely deep and low, especially do not suddenly stop with extra load and at a high speed. Refer to existing movement tips for lunges, for example, Hao Yan and Zhang Junnan reported in GOLFWORLD (August 2013, P. 91) that in a lunge position, it should be ensured that for the leg in the front, there is a straight angle between the thigh and the calf, and the knee cannot exceed the tiptoe. In addition, Song Qinghua reported in Teaching of Physical Education (May 2013, P. 62) that in exercise of lunge stretching, an angle between the calf and the thigh should be always kept to be greater than or equal to 90 degrees. In this way, the knee joint is not obviously extended or does not move back and forth. This reduces the rolling or sliding friction of the articular head in the fossa articularis to the greatest extent, thereby fully extending and stressing the medial ligaments of the thigh, and avoiding wear of the knee articular cartilage in a stressed state. Liu Shitong reported in Chinese Martial Arts (September 2000, P. 41) that when the knee joint bends less than 90°, only the rectus femoris muscle of the quadriceps femoris mainly plays a role in knee extension, and its muscle strength is weak; when the knee bends more than 90°, the other three muscles gradually play a role in knee extension.

Prior art patents aim at providing a leg-protecting apparatus or a knee-protecting apparatus for reducing swinging of muscles of sportsmen in an exercise process, increasing stability of the knee joint and reducing fatigue. Most of the apparatuses are calf-protecting and knee-protecting apparatuses which use different fabric combinations and the like to provide pressure constraint functions. In Chinese Patents (No. 201180062979.X and No. 201180003748.1), two different types of a calf-protecting apparatus and a knee joint-protecting apparatus are respectively disclosed for increasing pressure on gastrocnemius muscle of the calf and the knee joint by using the elasticity of different fabric structures. The former can effectively prevent, in exercise, the gastrocnemius muscle from swinging unduly and reduce the feeling of fatigue of the calf while providing a strong supporting function to the gastrocnemius muscle of the calf by using a cylindrical woven fabric. The latter can reduce, in exercise, load applied by knee tendons, improve stability of a knee joint, and reduce fatigue. In No. 201180062979.X, the patella is pressed by using a sleeved elastic band and a ring pad, so that the patella does not swing or move from side to side in exercise, so as to protect safety of the patella. In U.S. Pat. No. 7,749,181B2, a patella supporting kneepad is invented by using a patellofemoral brace to strengthen the fastening function. In U.S. Pat. No. 8,118,765B2, a flexible material is used to form a tubular body. A curvilinear stitching system is designed for the body according to the knee joint, so that using different elastic materials provides different tension performance in different regions. In U.S. Pat. No. 7,517,331B2, U.S. Pat. No. 8,579,843B2, and the like, an elastic fabric sports kneepad is provided. U.S. Pat. No. 7,517,331B2 uses an elastic insertion with a special shape and that surrounds the patella to fix the position of the patella in an exercise process, and reduce pressure on the patella. U.S. Pat. No. 8,579,843B uses an elastic fabric to cover the kneepad from the middle of the thigh to the middle of the calf, so as to fix the patella by using an oval insertion, and further provide protection to the knee joint during leg bending.

In the protecting apparatuses for reducing knee joint injuries in an exercise process disclosed in the foregoing patents, patella fixing and protection functions are implemented mainly by using a fabric elasticity, a fabric structure, a design for a special part of a knee joint, and the like. However, in exercise, muscles of legs of a human body are tensioned to different degrees hence single elastic fabric protection not only fails to provide reliable protection but also reduces comfort in an exercise process.

In addition, in the existing protecting apparatus, sweat is easily retained which reduces comfort.

Therefore it is necessary to provide a leg-protecting apparatus having a dynamic function to overcome the disadvantages in the prior art.

The present disclosure provides a leg-protecting apparatus arranged in close contact with a body surface of a wearer to cover a thigh, a knee, and a calf of the wearer, comprising a biomechanically protecting strap (A) arranged to correspond with structural locations and paths of tendons and ligaments of the knee and muscles proximal thereto during an exercise process; and said strap may comprise a cruciate ligament protecting strap (A-1), a patellar tendon protecting strap (A-2), a thigh muscle group protecting strap (A-3), and a calf muscle group protecting strap (A-4);

wherein the elastic moduli of the cruciate ligament protecting strap (A-1) and the patellar tendon protecting strap (A-2) may have a step-change upon a change in a fabric tensile ratio caused by the bending of the knee of the wearer, wherein the step-change may occur after an initial low tensile modulus stage, during a tensile sudden-change stage, and before a high tensile modulus stage transitioning between said stages as knee angle decreases.

In the leg-protecting apparatus provided in the present disclosure, the cruciate ligament protecting strap (A-1) may be a stripe region covering the front of the leg of the wearer, including a tibia of the calf, a patellar tendon, a patella, a knee joint, a ligament, and quadriceps femoris and extending lengthwise from one end of the protecting apparatus to the other end;

the patellar tendon protecting strap (A-2) may extend, from two sides of a knee part of the cruciate ligament protecting strap (A-1), obliquely upward along a lateral collateral ligament and an iliotibial band at a lateral side of the knee and along a medial collateral ligament and a pes anserinus tendon at a medial side of the knee to terminate at a side part of the thigh, being formed in an approximate U-shape for reinforcement;

the thigh muscle group protecting strap (A-3) may comprise a cross reinforcing part and a ring reinforcing part;

wherein the cross reinforcing part may cover a posterior thigh muscle group and may be formed in an "inverted Y"-shaped structure extending obliquely upward from two extension ends of the patellar tendon protecting strap (A-2) along the directions of opposite sides at the posterior thigh before merging;

the ring reinforcing part may run annularly around and may be secured to the thigh to cover the anterior quadriceps femoris and the posterior thigh muscle group;

wherein a lower edge of the ring reinforcing part located at one or more of the anterior thigh or posterior thigh may be engaged or partially overlap the cruciate ligament protecting strap (A-1), and the calf muscle group protecting strap (A-4) may be connected to both sides of the cruciate ligament protecting strap (A-1) and a lower edge of the patellar tendon protecting strap (A-2), and may wrap around a posterior part of the calf or have an X-shaped cross reinforcing part to cover a calf muscle group.

In the leg-protecting apparatus provided in the present disclosure, wherein the step-change may comprise:

when the fabric tensile ratio caused by the knee bending is 0 to T1, the protecting straps may be at the initial low tensile modulus stage, and the elastic modulus may be smaller than the first elastic modulus, wherein the first elastic modulus may be less than E1;

when the fabric tensile ratio caused by the knee bending is T1 to T2, the protecting straps enter the tensile sudden-change stage; wherein the elastic moduli non-linearly may increase to a second elastic modulus from the first elastic modulus with a change of the tensile ratio, wherein the second elastic modulus may be greater than E2; and when the fabric tensile ratio caused by the knee bending is greater than T2, the protecting straps may enter the high tensile modulus stage, wherein the elastic moduli may be greater than the second elastic modulus, wherein $T1<T2$, T1 may be equal to 20%±2, T2 may be equal to 25%±2, $E1\geq 0.5$ MPa, and $E2\geq 5\times E1$.

In the leg-protecting apparatus provided in the present disclosure, the protecting apparatus may further comprise a thermal comfort zone (B) for sweat removal which may be cylindrical, and said thermal comfort zone may extend from a lower portion on a gastrocnemius muscle of the calf to a thigh muscle group; wherein the thermal comfort zone (B) may comprise a posterior-leg thermal comfort zone (B-1) and an anterior-leg thermal comfort zone (B-2) that extend along the length direction of the protecting apparatus respectively, and join with each other.

In the leg-protecting apparatus provided in the present disclosure, the posterior-leg thermal comfort zone (B-1) may be made of a material configured to transmit sweat generated on the body surface of the wearer outside the protecting apparatus; and wherein material of the anterior-leg thermal comfort zone (B-2) may have a thickness less than 1 mm; and the overall moisture management capability when the materials of the posterior-leg thermal comfort zone (B-1) and the anterior-leg thermal comfort zone (B-2) deform more than 10% may be greater than or equal to 3.

In the leg-protecting apparatus provided in the present disclosure, the protecting apparatus may further comprise a reinforcing and anti-slipping strap (C) arranged at the end portion of the biomechanically protecting strap (A) and the thermal comfort zone (B); the reinforcing and anti-slipping strap (C) may comprise a lower-end reinforcing and anti-slipping strap (C-1) annularly bound to a protruded lower part of the gastrocnemius muscle of the calf, an upper-end reinforcing and anti-slipping strap (C-2) annularly bound to an upper part of the middle of the thigh, a below-the-knee-joint reinforcing and anti-slipping strap (C-4) annularly bound to a lower part of the knee joint or bound to a posterior part of the calf in an X-shaped crossing manner, and an above-the-knee-joint reinforcing and anti-slipping strap (C-3) annularly bound to an upper part of the knee joint or bound to a posterior part of the thigh in an X-shaped crossing manner, wherein the elastic moduli of the lower-end reinforcing and anti-slipping strap (C-1) and the upper-end reinforcing and anti-slipping strap (C-2) may be greater than 0.1 MPa, a friction coefficient may be greater than 0.4, and pressure may be greater than 10 mmHg.

In the leg-protecting apparatus provided in the present disclosure, the reinforcing and anti-slipping strap (C) comprises a strap and a Velcro tape/fastening tape.

In the leg-protecting apparatus provided in the present disclosure, the cruciate ligament protecting strap (A-1), the patellar tendon protecting strap (A-2), the thigh muscle group protecting strap (A-3), and the calf muscle group protecting strap (A-4) may use materials having corresponding non-linear elastic modulus properties.

In the leg-protecting apparatus provided in the present disclosure, the cruciate ligament protecting strap (A-1), the patellar tendon protecting strap (A-2), the thigh muscle group protecting strap (A-3), and the calf muscle group protecting strap (A-4) may use laminated composite materials affixed to material of the thermal comfort zone (B).

In the leg-protecting apparatus provided in the present disclosure, elastic moduli of the thigh muscle group protecting strap (A-3) and the calf muscle group protecting strap (A-4) may be greater than an elastic modulus of a basic fabric.

In the leg-protecting apparatus provided in the present disclosure, local elastic moduli of the thigh muscle group protecting strap (A-3) and the calf muscle group protecting strap (A-4) are more than 3 MPa.

The present disclosure provides a leg-protecting apparatus having dynamic biological functions, being in close contact with a body surface of a wearer and covering a thigh, a knee, and a calf of the wearer, comprising a biomechanically protecting strap (A) arranged on the basis of structural locations and paths of a tendon and a ligament of the knee and a muscle as well as a biomechanical feature of a human body in an exercise process; the biomechanically protecting strap (A) comprising a cruciate ligament protecting strap (A-1), a patellar tendon protecting strap (A-2), a thigh muscle group protecting strap (A-3), and a calf muscle group protecting strap (A-4), wherein the elastic moduli of the cruciate ligament protecting strap (A-1) and the patellar tendon protecting strap (A-2) have step-change based on a change in a fabric tensile ratio caused by the bending of the knee of the wearer, and wherein the step-change comprises an initial low tensile modulus stage, a tensile sudden-change stage, and a high tensile modulus stage that involve a gradual transition as a knee angle decreases.

Implementation of the leg-protecting apparatus configured on the basis of the biomechanical feature of the human body in the exercise process specifically includes four protecting straps for protecting main muscle groups or ligaments. The elastic moduli of the cruciate ligament protecting strap and the patellar tendon protecting strap may have a step-change upon a change in the fabric tensile ratio caused by the knee bending of the wearer, and the step-change occurs after the initial low tensile modulus stage, during the tensile sudden-change stage, and before the high tensile modulus stage transitioning between the stages as the knee angle decreases. Therefore, when a sportsman bends knees in an exercise process, comfortable elastic protection can be provided.

An elastic modulus of a knee material is correspondingly automatically adjusted according to knee angles caused by different knee bending amplitudes in exercise, so as to provide healthy and comfortable elastic protection in the case of both a small knee angle and a large amount of exercise.

When the knee bends slightly, the elastic moduli are at the initial low tensile modulus stage, which can reduce sports obstacles and enhance a sporting feeling;

when the knee bends more deeply, the elastic moduli are at the high tensile modulus stage, which can provide larger resilience for protection, thereby preventing or reducing knee joint injuries, preventing tendon, ligament, and muscle strains, and improving an exercise posture.

Meanwhile, according to different exercise requirements, the thigh muscle group protecting strap and the calf muscle group protecting strap are designed to strengthen muscle fastening forces of the calf and the thigh, so as to stabilize the knee joint and muscle groups, prevent or reduce knee joint injuries, prevent ligament and muscle strains, and improve exercise posture.

Further, the thermal comfort zone is configured to transmit sweat generated on the body surface of the wearer out of the protecting apparatus. This effectively improves transfer and evaporative efficiency of sweat at a knee fossa in the protecting apparatus, thereby improving the heat dissipation efficiency on the skin surface of the knee fossa, reducing increased core body temperature, and improving an exercise capability. The reinforcing and anti-slipping strap can prevent sliding of the protecting apparatus.

BRIEF DESCRIPTION OF THE DRAWINGS

The following further describes the present disclosure with reference to the accompanying drawings and the embodiments. In the accompanying drawings.

DETAILED DESCRIPTION

To make the technical features, objectives, and effects of the present disclosure more comprehensible, the following describes implementations of the present disclosure in detail with reference to the accompanying drawings.

The disclosure teaches, a leg-protecting apparatus which is approximately cylindrical, is in close contact with a body surface of a wearer to cover a thigh, a knee, and a calf of the wearer, and mainly includes a biomechanically protecting strap A, a thermal comfort zone B, and a reinforcing and anti-slipping strap C. The biomechanically protecting strap A is mainly configured to provide protection for ligament tension and the like in an exercise process based on a biomechanical feature of a human body in the exercise process without negatively influencing human body comfort. The thermal comfort zone B is a preferable feature, and mainly provides sweat removal function. The reinforcing and anti-slipping strap C is also a preferable feature, and is configured to fasten the protecting apparatus more reliably. Advantageously, the three parts may be used at the same time or may be used separately. The following separately describes the three parts.

Figure 1:
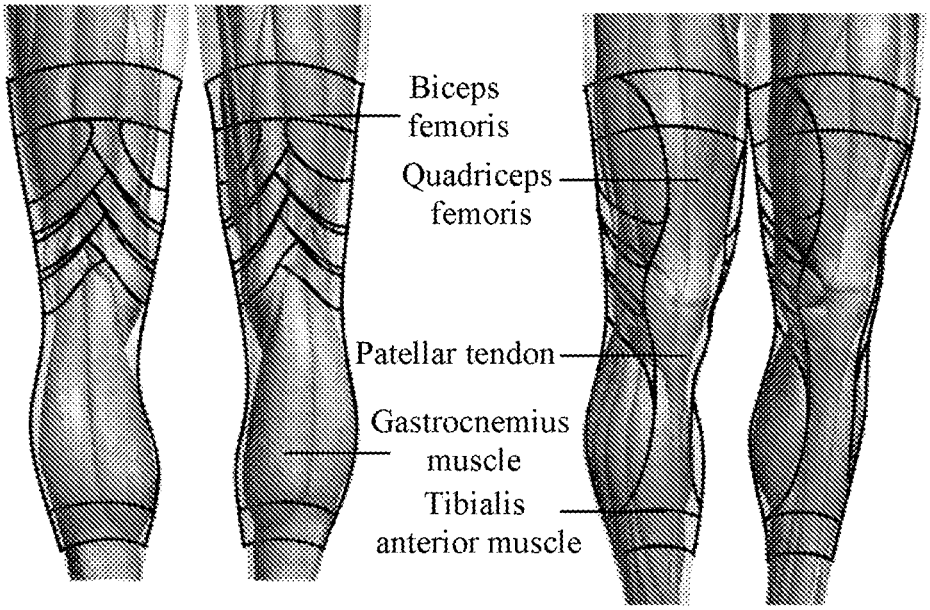
FIG. 1 is a schematic diagram of distribution of lower extremity muscles.
Figure 2:
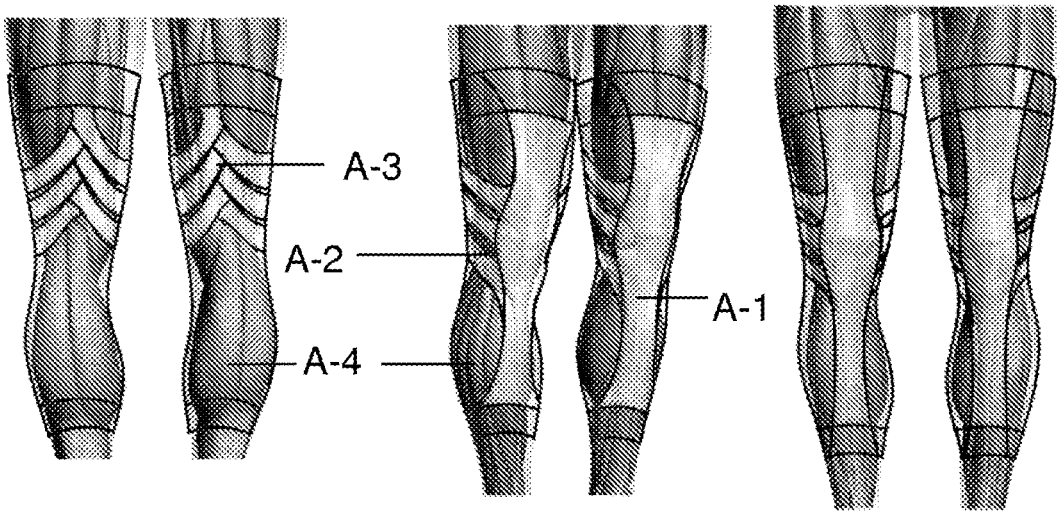
FIG. 2 is a schematic structural view of various portions of a biomechanically protecting strap of a leg-protecting apparatus according to embodiments of the present disclosure.

As shown in FIG. 2, the biomechanically protecting strap A arranged on the basis of the biomechanical features of the human body in the exercise process includes a cruciate ligament protecting strap A-1, a patellar tendon protecting strap A-2, a thigh muscle group protecting strap A-3, and a calf muscle group protecting strap A-4. The four protecting straps are mainly divided based on the tension situation of each of the tendons, muscles, and the like of the human body in the exercise process. Corresponding materials are matched for the tension situation of each of the protecting straps to provide healthy and comfortable elastic protection.

With reference to FIG. 2, the following describes structures and locations of each of the protecting straps in detail.

The cruciate ligament protecting strap A-1 is a stripe region covering the front of a leg of the wearer, and including a tibia of the calf, a patellar tendon, a patella, a knee joint, a ligament, and quadriceps femoris and extending lengthwise from one end of the protecting apparatus to the other end.

The patellar tendon protecting strap A-2 extends, from two sides of a knee part of the cruciate ligament protecting strap A-1, obliquely upward along a lateral collateral ligament and an iliotibial band at a lateral side of the knee and along a medial collateral ligament and a pes anserinus tendon at a medial side of the knee to terminate at a side part of the thigh, that is, extends obliquely upward along directions far away from the cruciate ligament protecting strap A-1 to terminate at the side part of the thigh, and being formed in an approximate U-shape for providing reinforcement, to the lateral side of the knee and the patellar tendon.

The thigh muscle group protecting strap A-3 includes a cross reinforcing part and a ring reinforcing part. The cross reinforcing part covers a posterior thigh muscle group and is formed in an "inverted Y"-shaped structure extending obliquely upward from two extension ends of the patellar tendon protecting strap A-2 along the directions of opposite sides at the posterior thigh before merging. The ring reinforcing part is located at an end of the protecting apparatus, and runs annularly around and is secured to the thigh to cover the anterior quadriceps femoris and the posterior thigh muscle group. A lower edge of the ring reinforcing part located at one or more of the anterior thigh or posterior thigh is engaged or partially overlaps the cruciate ligament protecting strap A-1, and a lower edge of the ring reinforcing part located at the posterior thigh is engaged or partially overlaps the cross reinforcing part. The cross reinforcing part covers the posterior thigh muscle groups such as biceps femoris and a semitendinosus muscle. The ring reinforcing part covers the quadriceps femoris muscle group of the anterior leg and the thigh muscle group such as the biceps femoris of the posterior leg.

The calf muscle group protecting strap A-4 wraps around a posterior part of the calf, is connected to both sides of the cruciate ligament protecting strap A-1 and a lower edge of the patellar tendon protecting strap A-2, and covers a calf muscle group such as a gastrocnemius muscle of the calf. The calf muscle group protecting strap A-4 may be made of materials having the same elastic modulus, or may be formed by an X-shaped cross reinforcing part having a large elastic modulus and the remaining part that has a small elastic modulus.

After the protecting straps are divided, corresponding materials are matched according to biomechanical features of each of the protecting straps, for mechanical protection. Specifically, elastic moduli of the cruciate ligament protecting strap A-1 and the patellar tendon protecting strap A-2 are selected to have a step-change upon a change in a fabric tensile ratio caused by the knee bending of the wearer. Elastic moduli of the thigh muscle group protecting strap A-3 and the calf muscle group protecting strap A-4 are greater than an elastic modulus of a basic fabric. For example, preferably, generally, the elastic moduli of the thigh muscle group protecting strap A-3 and the calf muscle group protecting strap A-4 are more than 3 MPa.

The foregoing has mentioned that a knee angle in exercise considerably affects the knee joint. Therefore, for ease of actual operations of a design, in the present disclosure, a design variable, that is, exercise intensity is set according to different knee angles in exercise and corresponding skin surface tension lengths. The variable is represented by level 1 to level 3. The representation method is a preferable representation method, but is not a unique representation method. Different levels may be set according to an actual requirement. For example, in a specific example, the exercise intensity is categorized as follows:

Level 1: a large knee angle and a small amount of exercise, where the knee angle is greater than or equal to 90°, and knee surface skin tension is less than or equal to 30%.

Level 2: an intermediate knee angle and an intermediate amount of exercise, where the knee angle is 60° to 90°, and knee surface skin tension is 30% to 40%.

Level 3: a small knee angle and a large amount of exercise, where the knee angle is less than 60°, and knee surface skin tension is greater than 40%.

It may be understood that in the foregoing example, the specific critical values of the knee angles and the knee surface skin tension between each of the levels corresponding to the three levels are only examples. This is because mechanical features of human body knees are approximately classified into three stages, and critical values between each of the stages may be set according to an actual situation.

According to change characteristics of the three levels of the exercise intensity, in the present disclosure, materials of the cruciate ligament protecting strap A-1 and the patellar tendon protecting strap A-2 are designed as materials having the same variation trend, and include three stages of elastic change properties. The step-change of the elastic moduli of the cruciate ligament protecting strap A-1 and the patellar tendon protecting strap A-2 upon a change in the fabric tensile ratio caused by the knee bending of the wearer includes:

an initial low tensile modulus stage: the fabric tensile ratio is 0 to T1, and the elastic modulus is smaller than the first elastic modulus, where the first elastic modulus is less than E1;

a tensile sudden-change stage: the fabric tensile ratio is T1 to T2, the elastic moduli non-linearly increase to a second elastic modulus from the first elastic modulus with a change of the tensile ratio, where the second elastic modulus is greater than E2; and a high tensile modulus stage: the fabric tensile ratio is greater than T2, and the elastic moduli substantially remain unchanged, and is greater than the second elastic modulus, where $T1<T2$, and preferably, T1 is equal to 20%±2, T2 is equal to 25%±2, $E1\geq 0.5$ MPa, and $E2\geq 5\times E1$.

It should be noted that each protecting strap may be prepared by using the material having the foregoing feature of the step-change in the elastic moduli. Therefore, the protecting straps A-1 to A-4 may use non-linear materials having corresponding properties of the elastic moduli, and the non-linear materials are integrated. The protecting straps A-1 to A-4 may alternatively use laminated composite materials. Local elastic moduli of materials are increased by using a strap, an adhesive, or the like. For example, the composite materials are affixed to a material of the thermal comfort zone B having a dynamic unidirectional water guide function.

In this embodiment, an elastic knitted fabric formed by ordinary ground yarns and elastic spandex yarns may be used for implementation. In a knitting process, the ground yarns and the elastic yarns are separately tensioned to some extent. After the knitting, because coils are naturally overlapped, specific material performance characteristics and regions may be formed.

A formula for calculating a stress σ in the first stage is as follows:

$$\sigma = Ee \times \varepsilon,\ \varepsilon \leq \varepsilon 1,$$

where ε and ε1 are respectively a strain and a critical value of the strain in the first stage, and Ee is an elastic modulus in the first stage and is caused by deformation of the elastic yarns.

The second stage may be simulated by using a model in which three springs are connected in serial-parallel, and a formula for calculating a stress σ is as follows:

$$\sigma = (Ee*Eg/(Ee+Eg)+Ee) \times \varepsilon, \varepsilon 1 < \varepsilon \leq (\varepsilon 1+\varepsilon 2),$$

where ε2 is a critical value of a strain in the second stage, Es is an elastic modulus caused by inter-coil sliding and coil transfer, and Eg is an elastic modulus caused by deformation of the ground yarns.

The third stage may be simulated by using a model in which two springs are connected in parallel, and a formula for calculating a stress σ is as follows:

$$\sigma = (Ee+Eg) \times \varepsilon,\ \varepsilon > (\varepsilon 1+\varepsilon 2),$$

where Ee is an elastic modulus caused by deformation of the elastic yarns, and Eg is an elastic modulus caused by deformation of the ground yarns.

Figure 3:
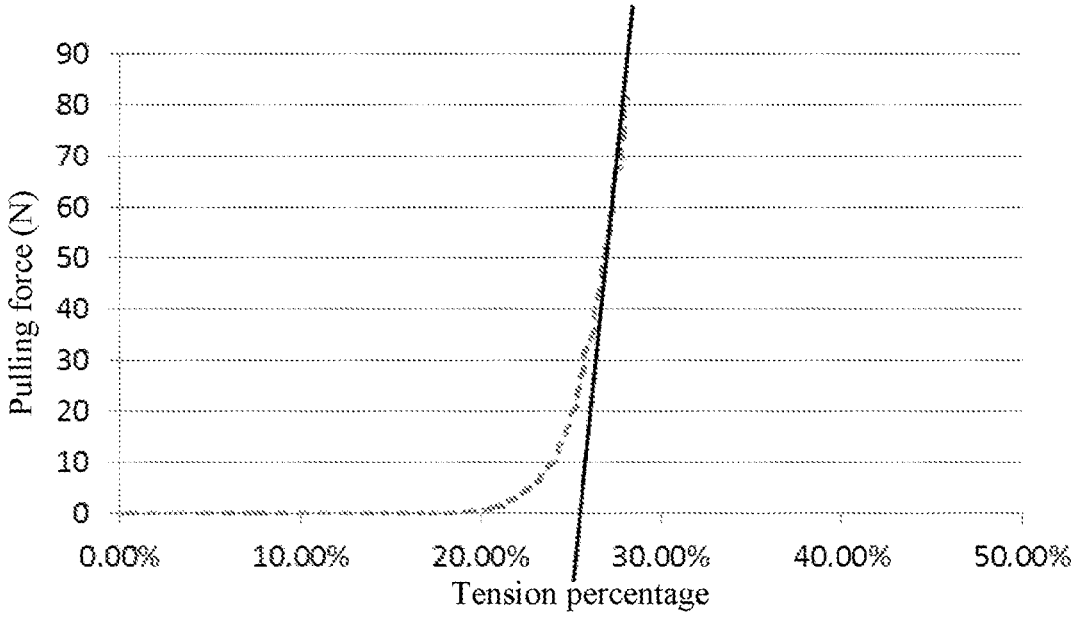
FIG. 3 is a force-tension diagram depicting the mechanical properties of materials of a cruciate ligament protecting strap and a patellar tendon protecting strap.

In a specific example, referring to FIG. 3, in a preferred embodiment, the cruciate ligament protecting strap A-1 and the patellar tendon protecting strap A-2 use non-linear materials, where T1 is 20% and T2 is 25%. In the figure, a curve represents a force-tension curve of the material, and a slope of a stress-strain curve indicates an elastic modulus.

When the fabric tensile ratio is in an interval of 0 to 20%, the protecting straps are at the initial low tensile modulus stage, which is a stage in which the elastic yarns are tensioned, where a force that needs to be applied to tension the fabric is relatively small, and the elastic moduli are relatively small. When the fabric tensile ratio is in an interval of 20% to 25%, the protecting straps enter the tensile sudden-change stage, which is a stage in which the ground yarns are tensioned and the coils are transferred, where a force that needs to be applied to tension the fabric suddenly increases, and the elastic moduli suddenly increase. When the fabric tensile ratio is greater than 25%, the protecting straps enter the high tensile modulus stage, which is a stage in which the elastic yarns and the ground yarns are tensioned, where a force that needs to be applied to tension the fabric is relatively large, and the elastic moduli are relatively large.

Therefore, in the present disclosure, designs of the cruciate ligament protecting strap A-1 and the patellar tendon protecting strap A-2 and selection of their materials are based on a human physiological condition and a specific exercise requirement, so as to provide comfortable elastic protection under a precondition of safety and comfort when a sportsman is doing a knee bending action. An elastic modulus of a knee material is correspondingly automatically adjusted according to knee angles caused by different knee bending amplitudes in exercise, so as to provide healthy and comfortable elastic protection in the case of both a small knee angle and a large amount of exercise. For example, when the sportsman is doing a squat, the below comfortable elastic protection is provided: when the knee angle is relatively large, resilience of the protecting strap is relatively small, comfortable supporting protection is provided to reduce sports obstacles; when the knee angle is excessively small, that is, a bending amplitude is excessively large, larger resilience is provided. In addition, according to different exercise requirements, the thigh muscle group protecting strap A-3 and the calf muscle group protecting strap A-4 are designed to strengthen muscle fastening forces of the calf and the thigh, so as to stabilize the knee joint and muscle groups, prevent or reduce knee joint injuries, prevent ligament and muscle strains, and improve an exercise posture.

Figure 4:
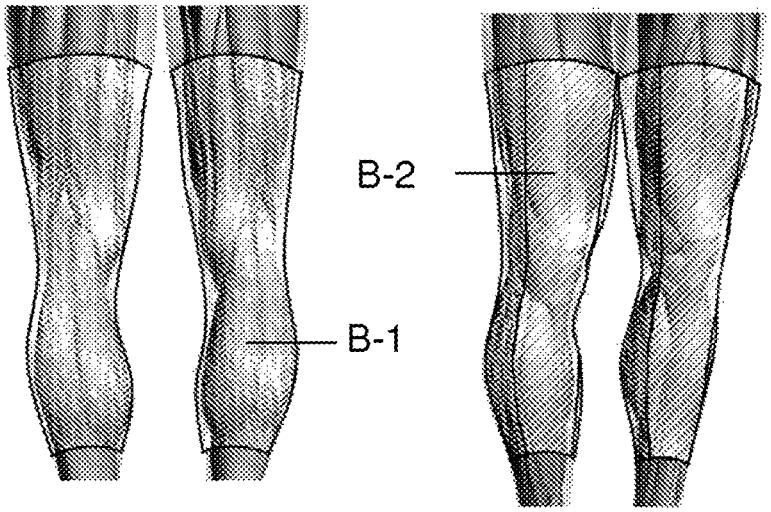
FIG. 4 is a schematic structural diagram of a thermal comfort zone of a leg-protecting apparatus according to an embodiment of the present disclosure.

Preferably, the present disclosure further provides a thermal comfort zone B to remove sweat. Referring to FIG. 4, FIG. 4 is a schematic structural diagram of a thermal comfort zone of a leg-protecting apparatus of an embodiment of the disclosure.

Advantageously, the thermal comfort zone B is cylindrical, and is sectorial when being extended, and extends from a lower portion on a gastrocnemius muscle of the calf to a thigh muscle group. An overlapping region of the biomechanically protecting strap A and the thermal comfort zone B has both a mechanical protection function and a sweat removal function. Therefore, the biomechanically protecting strap A may be fixed on the thermal comfort zone B, or the thermal comfort zone B uses a composite material and has both an elastic protection function of the biomechanically protecting strap A and a sweat removal function.

The thermal comfort zone B includes a posterior-leg thermal comfort zone B-1 and an anterior-leg thermal comfort zone B-2. The two parts are arranged to extend along the length direction of the protecting apparatus respectively, and join with each other to form a cylindrical shape at two sides of a leg. The posterior-leg thermal comfort zone B-1 is made of a material having a dynamic unidirectional water guide function configured to transmit sweat generated on the body surface of the wearer outside the protecting apparatus. A material of the anterior-leg thermal comfort zone B-2 is thin and generally has a thickness less than 1 mm. The entire thermal comfort zone B can be used for providing both comfort and sweat removal. The overall moisture management capability when the materials of the posterior-leg thermal comfort zone B-1 and the anterior-leg thermal comfort zone B-2 deform more than 10% is greater than or equal to 3.

Because the posterior-leg thermal comfort zone B-1 is configured by a dynamic unidirectional water guide fabric, according to an angle change of a knee fossa in an exercise process, the posterior-leg thermal comfort zone B-1 actively absorbs sweat on the skin surface of the knee fossa and transmits the sweat to an outer surface of the protecting apparatus. The sweat quickly evaporates on the surface of the protecting apparatus, so as to remove heat on the skin surface. This effectively improves transfer and evaporative efficiency of sweat at a knee fossa in the protecting apparatus, thereby improving the heat dissipation efficiency on the skin surface of the knee fossa, reducing a rising rate of the core body temperature, and improving an exercise capability.

One example of such material having the dynamic unidirectional water guide function, is taught in Chinese Patent Application "DESIGN PRINCIPLE AND MANUFACTURING METHOD OF POROUS MATERIAL HAVING DYNAMIC ADSORPTION AND TRANSFER FUNCTIONS, 201210378024.1". For a method for measuring the overall moisture management capability, refer to National Standards GB21655.2-2009, *Textiles—Evaluation of absorption and quick-drying—Part 2: Method for moisture management tests.*

Figure 5:
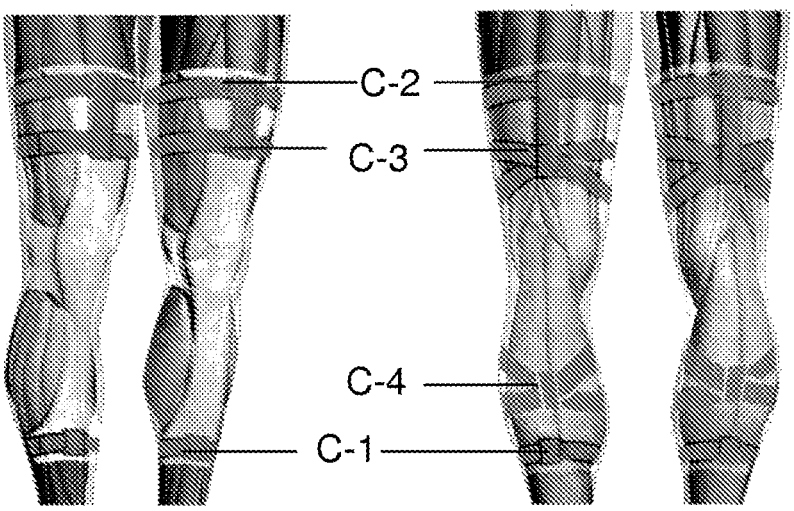
FIG. 5 is a schematic structural diagram of a reinforcing and anti-slipping strap of a leg-protecting apparatus according to an embodiment of the present disclosure.

Further, preferably, the present disclosure further provides a reinforcing and anti-slipping strap C. Referring to FIG. 5, FIG. 5 is a schematic structural diagram of a reinforcing and anti-slipping strap of a leg-protecting apparatus.

The reinforcing and anti-slipping strap C uses a strap and a Velcro tape/fastening tape. The reinforcing and anti-slipping strap C includes a lower-end reinforcing and anti-slipping strap C-1 and an upper-end reinforcing and anti-slipping strap C-2, and preferably further includes a below-the-knee-joint reinforcing and anti-slipping strap C-4 and an above-the-knee-joint reinforcing and anti-slipping strap C-3. The lower-end reinforcing and anti-slipping strap C-1 is annularly bound to a protruded lower part of the gastrocnemius muscle of the calf, the upper-end reinforcing and anti-slipping strap C-2 is annularly bound to an upper part of the middle of the thigh, the below-the-knee-joint reinforcing and anti-slipping strap C-4 and the above-the-knee-joint reinforcing and anti-slipping strap C-3 are bound to a lower part or an upper part of the knee joint annularly or in an X-shaped crossing manner. Elastic moduli of the lower-end reinforcing and anti-slipping strap C-1 and the upper-end reinforcing and anti-slipping strap C-2 are greater than 0.1 MPa, the friction coefficient is greater than 0.4, and the pressure is greater than 10 mmHg.

The First Embodiment

Figure 6:
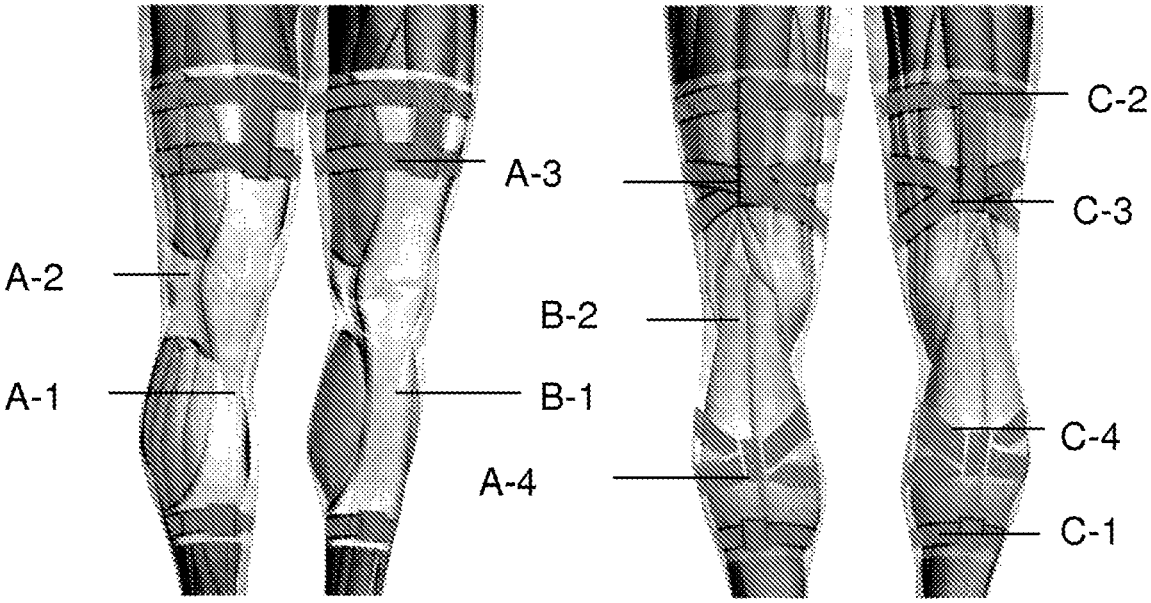
FIG. 6 is a schematic structural diagram of the first embodiment of a leg-protecting apparatus according to an embodiment of the present disclosure.

Referring to FIG. 6, FIG. 6 is a schematic structural diagram of the first embodiment of a leg-protecting apparatus of the present disclosure.

In the first embodiment, the structures and locations of each of the protecting straps are similar to the descriptions of FIG. 2, and details are not described herein again. In this embodiment, the patellar tendon protecting strap A-2 specifically includes two protecting straps that start from a lower edge of the patella, where there are one protecting strap on each of the left side and the right side. Both of the protecting straps extend upward along two sides of the cruciate ligament protecting strap A-1 to increase pressure and support for the patellar tendon.

Woven materials having different elastic moduli in different deformation conditions are prepared by using existing technologies, which are used for the leg-protecting apparatus of the present design. Material properties in all regions are specifically shown in the below table. In this embodiment, materials corresponding to each of the regions are stitched together to form an integrated cylindrical.

TABLE 1

| Region | Material property |
|---|---|
| Cruciate ligament protecting strap A-1 | The weight per unit is 206.8 g/m2, the thickness is smaller than 0.99 mm, the stiffness is smaller than 1, the forward warp elastic modulus is smaller than 10.44 MPa, the return warp elastic modulus is smaller than 7.8 MPa, the forward welt elastic modulus is smaller than 5.58 MPa, the return welt elastic modulus is smaller than 4.52 MPa, the warp hysteresis is smaller than 0.031, the welt hysteresis is smaller than 0.01, and the overall moisture management capability is greater than or equal to 3. |
| Posterior-leg thermal comfort zone B-1 | The weight per unit is 266.9 g/m2, the thickness is smaller than 1.20 mm, the stiffness is 2 to 3, the forward warp elastic modulus is smaller than 0.03 MPa, the return warp elastic modulus is smaller than 0.05 MPa, the forward welt elastic modulus is smaller than 0.03 MPa, the return welt elastic modulus is smaller than 0.04 MPa, the warp hysteresis is smaller than 0.005, the welt hysteresis is smaller than 0.003, and the overall moisture management capability is greater than or equal to 3. |
| Reinforcing and anti-slipping strap C | The weight per unit is 358 g/m2, the thickness is smaller than 2.50 mm, and the forward welt elastic modulus is smaller than 0.1 |

An actual wearing test result indicates that in a controllable environmental meteorological chamber, when a tester wears the protecting apparatus and repeatedly squats and stands, pressure applied on the patellar tendon of the tester is largest when a knee angle is 90° during squat, and an average value is 55 mmHg; and pressure is smallest when a knee angle is 180° during standing up, and an average value is 30 mmHg.

The Second Embodiment

Figure 7:
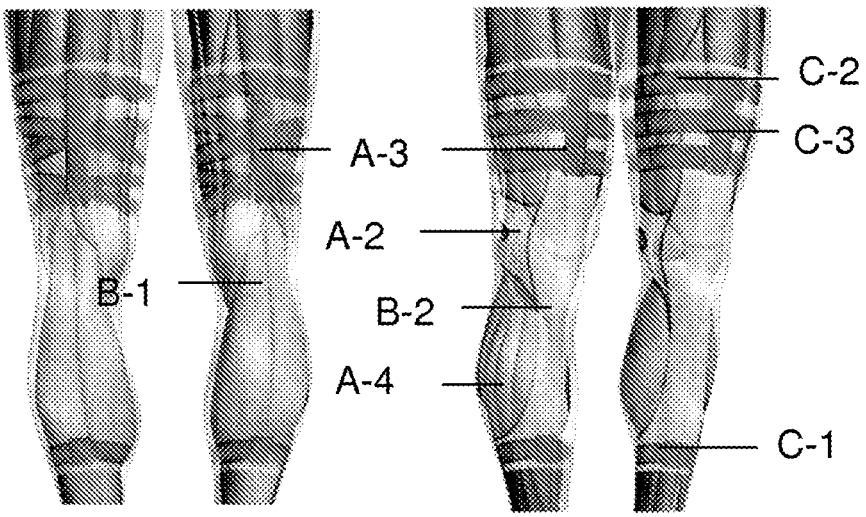
FIG. 7 is a schematic structural diagram of the second embodiment of a leg-protecting apparatus according to an embodiment of the present disclosure.

Referring to FIG. 7, the second embodiment and the first embodiment may describe different strap methods of the same leg-protecting apparatus. For example, in the figure, the below-the-knee-joint reinforcing and anti-slipping strap C-4 is omitted, and another above-the-knee-joint reinforcing and anti-slipping strap C-3 is added based on the first embodiment to strengthen pressure on the protecting strap, thereby strengthening a tightening force and a supporting force of this part. In addition, the patellar tendon protecting strap A-2 specifically includes four protecting straps that start from a lower edge of the patella, where there are two protecting straps on each of the left side and the right side. All of the four protecting straps extend upward along two sides of the cruciate ligament protecting strap A-1 to increase pressure and support for the patellar tendon.

The Third Embodiment

Figure 8:
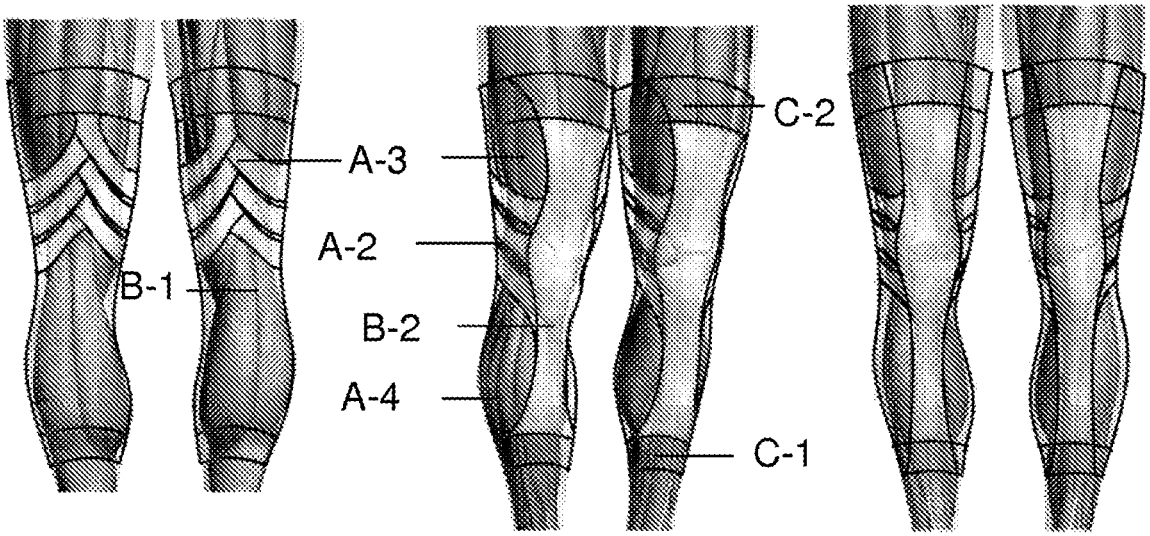
FIG. 8 is a schematic structural diagram of the third embodiment of a leg-protecting apparatus according to an embodiment of the present disclosure.

Referring to FIG. 8, in this embodiment, resilience is strengthened by using the combination of a material of the thermal comfort zone B that has a dynamic unidirectional water guide function and a laminated composite material. A press adhesive method is used in each of the protecting straps to strengthen pressure of the protecting strap, so as to strengthen a tightening force and a supporting force of this part. The patellar tendon protecting strap A-2 specifically includes six protecting straps that start from a lower edge of the patella, where there are three protecting straps on each of the left side and the right side. All of the six protecting straps that start from the lower edge of the patella extend upward along two sides of the cruciate ligament protecting strap A-1 to increase pressure and support for the patellar tendon.

The properties of the laminated material are: the weight per unit is 250 g/m2, the thickness is smaller than 1.1 mm, the air resistance is 0.03 kPa·s/m, the heat insulation degree is 0.19 Clo, the stiffness is smaller than 1, the forward wrap elastic modulus is smaller than 10.44 MPa, the return wrap elastic modulus is smaller than 7.8 MPa, the forward welt elastic modulus is smaller than 5.58 MPa, the return welt elastic modulus is smaller than 4.52 MPa, the warp hysteresis is smaller than 0.031, and the welt hysteresis is smaller than 0.01.

The Fourth Embodiment

Figure 9:
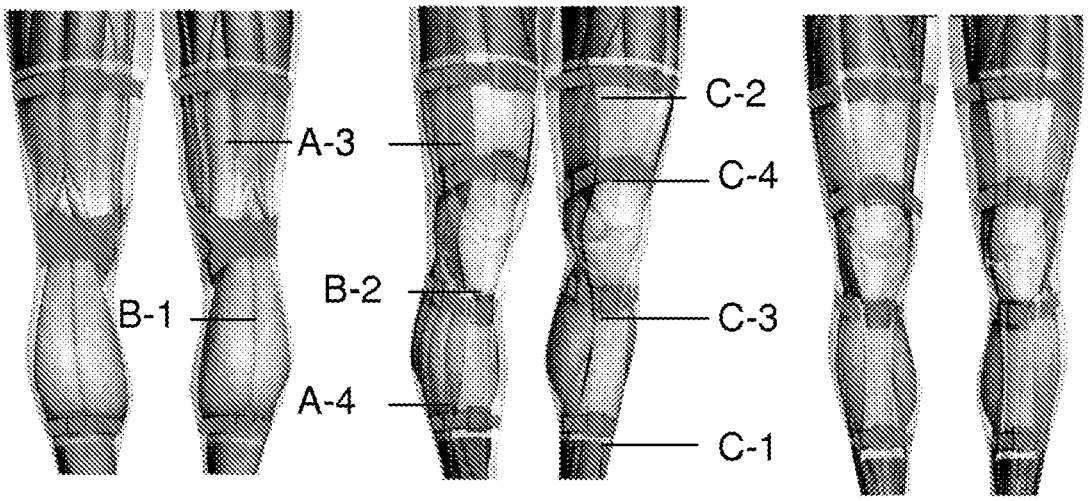
FIG. 9 is a schematic structural diagram of the fourth embodiment of a leg-protecting apparatus according to an embodiment of the present disclosure.

Referring to FIG. 9, in the fourth embodiment, full-leg protection is mainly for further strengthening stability of the patella. An X-shaped fastening member is added at a knee fossa. The X-shaped fastening member is transversely disposed at the knee fossa, and two connection ends extending upward and downward on two sides of the X-shaped fastening member separately connect an elastic strap. The strap is a semicircle, and is fixed by using a Velcro tape separately on upper and lower parts of the patella, so as to stabilize the patella. A material of the X-shaped fastening member added at the knee fossa is the same as that of the cruciate ligament protecting strap A-1.

An actual wearing test result indicates that in a controllable environmental meteorological chamber, when a tester wears the designed protecting apparatus and repeatedly squats and stands, pressure applied on the patellar tendon of the tester is shown to be largest when a knee angle is 90° during squat, and an average value is 45 mmHg; and the pressure is smallest when a knee angle is 180° during standing up, and an average value is 12 mmHg.

In conclusion, in the present disclosure, the biomechanically protecting strap is arranged relative to the biomechanical feature of the human body in the exercise process and may specifically include four protecting straps for protecting main muscle groups or ligaments. The elastic moduli of the cruciate ligament protecting strap and the patellar tendon protecting strap may have a step-change upon a change in the fabric tensile ratio caused by the knee bending of the wearer. Therefore, when a sportsman bends knees in an exercise process, comfortable elastic protection can be provided. An elastic modulus of a knee material is correspondingly automatically adjusted according to knee angles caused by different knee bending amplitudes in exercise, so as to provide healthy and comfortable elastic protection in the case of both a small knee angle and a large amount of exercise. When the knee bends slightly, sports obstacles are reduced and a sporting feeling is enhanced; when the knee bends greatly, larger resilience is provided for protection, thereby preventing or reducing knee joint injuries, preventing tendon, ligament, and muscle strains, and improving an exercise posture. Meanwhile, according to different exercise requirements, the thigh muscle group protecting strap and the calf muscle group protecting strap are designed to strengthen muscle fastening forces of the calf and the thigh, so as to stabilize the knee joint and muscle groups, prevent or reduce knee joint injuries, prevent ligament and muscle strains, and improve an exercise posture. Further, the thermal comfort zone is configured by a dynamic unidirectional water guide fabric, which can pump sweat generated on the body surface of the wearer out of the protecting apparatus. This effectively improves the transfer and evaporative efficiency of sweat at a knee fossa in the protecting apparatus, thereby improving the heat dissipation efficiency on the skin surface of the knee fossa, reducing a rising rate of the core body temperature, and improving an exercise capability.

The foregoing describes the embodiments of the present disclosure with reference to the accompanying drawings. However, the present disclosure is not limited to the foregoing specific implementations. The foregoing specific implementations are exemplary, rather than limitative. A person of ordinary skill in the art may make, according to teachings of the present disclosure, many variations without departing from the principle of the present disclosure and the protection scope of the claims, and all of the variations shall fall within the protection scope of the present disclosure.

What is claimed is:

1. A leg-protecting apparatus comprising a fabric arranged in close contact about a body surface of a wearer to cover a thigh, a knee, and a calf of the wearer, comprising:

a biomechanically protecting strap (A) integrally formed within the fabric and configured to be arranged to substantially align with structural locations and paths of tendons and ligaments of the knee and muscles proximal thereto during an exercise process; said biomechanically protecting strap comprising a cruciate ligament protecting strap (A-1), a patellar tendon protecting strap (A-2), a thigh muscle group protecting strap (A-3), and a calf muscle group protecting strap (A-4), wherein:

the cruciate ligament protecting strap is a stripe region configured to cover a front of a leg of the wearer, including a tibia of the calf, a patellar tendon, a patella, a knee joint, a ligament, and quadriceps femoris and extending lengthwise from one end of the leg-protecting apparatus to the other end;

the patellar tendon protecting strap is configured to extend, from two sides of a knee part of the cruciate ligament protecting strap, obliquely upward along a lateral collateral ligament and an iliotibial band at a lateral side of the knee, and along a medial collateral ligament and a pes anserinus tendon at a medial side of the knee to terminate at a side part of the thigh, being formed in an approximate U-shape for reinforcement;

said biomechanically protecting strap comprises at least two materials, each having different non-linear elastic moduli under tension; and a change in a fabric tensile ratio is configured to be caused by a bending of the knee of the wearer causes an effective elastic moduli of the cruciate ligament protecting strap and the patellar tendon protecting strap to transition non-linearly from an initial low tensile modulus stage, through a tensile sudden-change stage, and to a high tensile modulus stage as knee angle decreases.

2. The leg-protecting apparatus according to claim 1, wherein, the thigh muscle group protecting strap (A-3) comprises a cross reinforcing part and a ring reinforcing part;

wherein the cross reinforcing part is configured to cover a posterior thigh muscle group and is formed in an "inverted Y"-shaped structure extending obliquely upward from two extension ends of the patellar tendon protecting strap (A-2) along the directions of opposite sides at the a posterior thigh before merging;

the ring reinforcing part runs annularly around and is configured to be secured to the thigh and configured to cover an anterior quadriceps femoris and the posterior thigh muscle group;

wherein a lower edge of the ring reinforcing part is configured to be located at one or more of an anterior thigh or a posterior thigh is configured to engage or partially overlap the cruciate ligament protecting strap (A-1), and the calf muscle group protecting strap (A-4) is connected to both sides of the cruciate ligament protecting strap (A-1) and a lower edge of the patellar tendon protecting strap (A-2), and is configured to wrap around a posterior part of the calf or has an X-shaped cross reinforcing part configured to cover a calf muscle group.

3. The leg-protecting apparatus according to claim 1, wherein the change comprises:

when the fabric tensile ratio caused by the knee bending is in a range of 0 to T1, the cruciate ligament protecting strap and the patellar tendon protecting strap are at the initial low tensile modulus stage, and the elastic modulus of each of the cruciate ligament protecting strap and the patellar tendon protecting strap is smaller than a first elastic modulus, wherein the first elastic modulus is less than E1 wherein E1≥0.5 MPa and T1 is equal to 20%±2;

when the fabric tensile ratio caused by the knee bending is in a range of T1 to T2, wherein T2 is equal to 25%±2, the cruciate ligament protecting strap and the patellar tendon protecting strap enter the tensile sudden-change stage; wherein the elastic modulus of each of the cruciate ligament protecting strap and the patellar tendon protecting strap non-linearly increases to a second elastic modulus from the first elastic modulus with a change of the fabric tensile ratio, wherein the second elastic modulus is greater than E2, wherein E2≥5×E1; and when the fabric tensile ratio caused by the knee bending is greater than T2, the protecting straps enter the high tensile modulus stage wherein the elastic moduli are greater than the second elastic modulus.

4. The leg-protecting apparatus according to claim 1, wherein the protecting apparatus further comprises a thermal comfort zone (B) for sweat removal which is cylindrical, said thermal comfort zone configured to extend from a lower portion on a gastrocnemius muscle of the calf to a thigh muscle group; wherein the thermal comfort zone (B) comprises a posterior-leg thermal comfort zone (B-1) and an anterior-leg thermal comfort zone (B-2) that extend along the length direction of the protecting apparatus respectively, and join with each other.

5. The leg-protecting apparatus according to claim 4, wherein the posterior-leg thermal comfort zone (B-1) is made of a material configured to transmit sweat generated on the body surface of the wearer outside the protecting apparatus; and wherein a material of the anterior-leg thermal comfort zone (B-2) has a thickness less than 1 mm; and the overall moisture management capability when the materials of the posterior-leg thermal comfort zone (B-1) and the anterior-leg thermal comfort zone (B-2) deform more than 10% is greater than or equal to 3.

6. The leg-protecting apparatus according to claim 4, further comprising a reinforcing and anti-slipping strap (C) arranged at an end portion of the biomechanically protecting strap (A) and the thermal comfort zone (B);

the reinforcing and anti-slipping strap (C) comprising a lower-end reinforcing and anti-slipping strap (C-1) configured to be annularly bound to a protruded lower part of the gastrocnemius muscle of the calf, an upper-end reinforcing and anti-slipping strap (C-2) configured to be annularly bound to an upper part of a middle of the thigh, a below-the-knee-joint reinforcing and anti-slipping strap (C-4) configured to be annularly bound to a lower part of a knee joint or bound to a posterior part of the calf in an X-shaped crossing manner, and an above-the-knee-joint reinforcing and anti-slipping strap (C-3) configured to be annularly bound to an upper part of the knee joint or bound to a posterior part of the thigh in an X-shaped crossing manner, wherein each of the lower-end reinforcing and anti-slipping strap (C-1) and the upper-end reinforcing and anti-slipping strap (C-2) has an elastic modulus greater than 0.1 MPa, a friction coefficient greater than 0.4, and a pressure greater than 10 mmHg.

7. The leg-protecting apparatus according to claim 6 wherein the reinforcing and anti-slipping strap (C) comprises a strap and a hook-and-loop-type fastening tape.

8. The leg-protecting apparatus according to claim 4, wherein the cruciate ligament protecting strap (A-1), the patellar tendon protecting strap (A-2), the thigh muscle group protecting strap (A-3), and the calf muscle group protecting strap (A-4) use materials having corresponding non-linear elastic modulus properties.

9. The leg-protecting apparatus according to claim 4, wherein the cruciate ligament protecting strap (A-1), the patellar tendon protecting strap (A-2), the thigh muscle group protecting strap (A-3), and the calf muscle group protecting strap (A-4) use laminated composite materials affixed to a material of the thermal comfort zone (B).

10. The leg-protecting apparatus according to claim 1, wherein elastic moduli of the thigh muscle group protecting strap (A-3) and the calf muscle group protecting strap (A-4) are greater than an elastic modulus of a basic fabric.

11. The leg-protecting apparatus according to claim 10, wherein local elastic moduli of the thigh muscle group protecting strap (A-3) and the calf muscle group protecting strap (A-4) are more than 3 MPa.

12. A leg-protecting apparatus having dynamic biological functions, being in close contact with a body surface of a wearer and covering a thigh, a knee, and a calf of the wearer, comprising:

a biomechanically protecting strap (A) configured to be arranged according to the basis of structural locations and paths of a tendon and a ligament of the knee and a muscle as well as a biomechanical feature of a human body in an exercise process; the biomechanically protecting strap (A) comprising a cruciate ligament protecting strap (A-1), a patellar tendon protecting strap (A-2), a thigh muscle group protecting strap (A-3), and a calf muscle group protecting strap (A-4), wherein elastic moduli of the cruciate ligament protecting strap (A-1) and the patellar tendon protecting strap (A-2) have a step-change based on a change in a fabric tensile ratio configured to be caused by a bending of the knee of the wearer, and wherein the step-change comprises an initial low tensile modulus stage, a tensile sudden-change stage, and a high tensile modulus stage that involves a gradual transition as a knee angle decreases.

* * * * *